United States Patent [19]

Whitehead

[11] Patent Number: 4,878,321

[45] Date of Patent: Nov. 7, 1989

[54] AUTOMATIC PORTABLE SHARPENING KIT FOR ELECTRIC CATTLE SHEARERS/CLIPPERS

[76] Inventor: Stanley A. Whitehead, P.O. Box 805, Kemptville, Ontario, Canada, K0G 1J0

[21] Appl. No.: 221,664

[22] Filed: Jul. 20, 1988

[51] Int. Cl.[4] ..... B24D 17/00

[52] U.S. Cl. ..... 51/358; 76/82; 51/211 R

[58] Field of Search ..... 51/204, 211 R, 211 H, 51/285, 358; 76/82

[56] References Cited

U.S. PATENT DOCUMENTS

| | | | |
|---|---|---|---|
| 1,448,014 | 3/1923 | Welch | 51/211 H |
| 1,571,555 | 2/1926 | Niesen | 51/211 R |
| 1,824,531 | 9/1931 | Bennett et al. | 51/211 R |
| 2,790,339 | 4/1957 | Brink | 76/82 |
| 3,677,316 | 7/1972 | Markham | 51/250 |
| 3,900,970 | 8/1975 | Sollami | 51/98 BS |
| 4,078,338 | 3/1978 | Baughcom | 51/285 |

*Primary Examiner*—Frederick R. Schmidt
*Assistant Examiner*—Judy J. Hartman
*Attorney, Agent, or Firm*—Pascal & Associates

[57] ABSTRACT

For use in a shearer/clipper comprised of a pair of oscillating drive arms for moving a first removable blade in a wiping motion relative to an adjacent removable stationary blade, for effecting a shearing action therebetween, a sharpening kit comprised of a flat block having an abrasive surface, for connection to the shearer/clipper in place of the removable stationary blade, and apparatus for connecting a selected one of either the first or stationary blades to the oscillating drive arms, whereby the oscillating drive arms move the selected blade in a wiping motion relative to and bearing down on the abrasive surface thereby sharpening the selected blade.

6 Claims, 4 Drawing Sheets

AUTOMATIC PORTABLE SHARPENING KIT FOR ELECTRIC CATTLE SHEARERS/CLIPPERS

Figure 1:
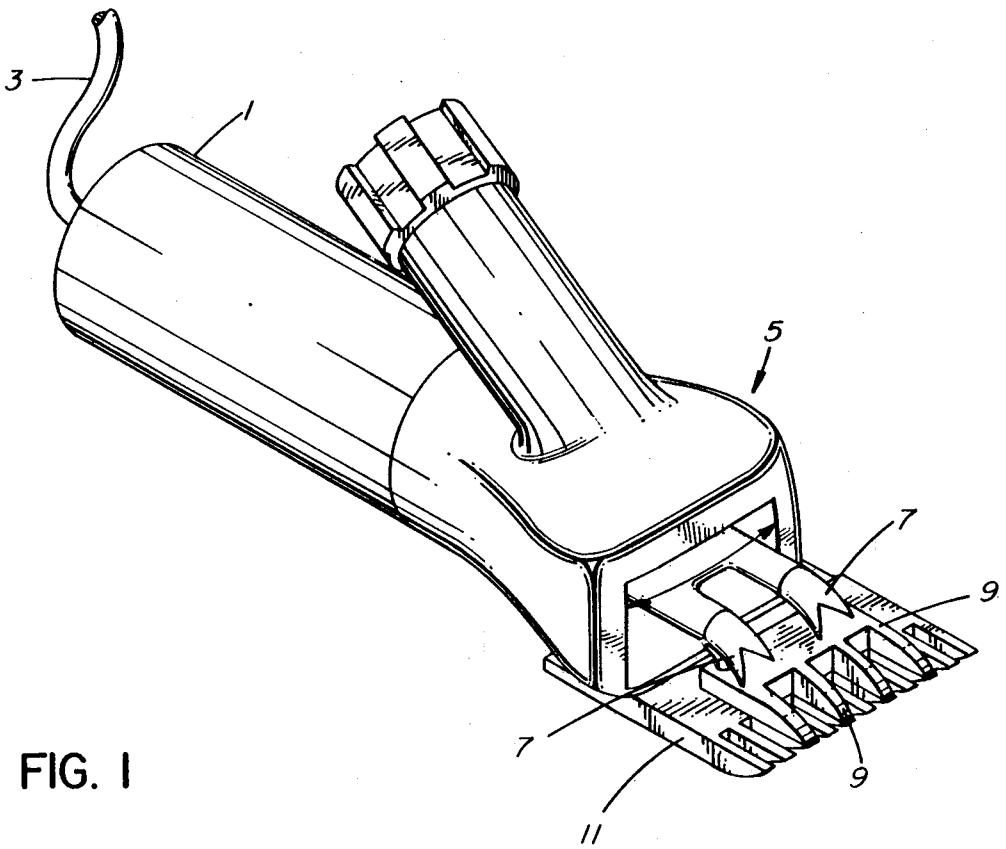

This invention relates in general to blade sharpeners, and more particularly to a portable sharpening kit for sharpening electric cattle shearer/clipper blades.

Electric cattle shearers/clippers are often used to shear or clip the hair on cattle or other livestock. The shearer/clipper is typically in the form of a hand held unit comprised of a handle having an electric cord connected thereto, and a head unit having a pair of oscillating drive arms extending therefrom, which move back and forth in a wiping motion. A flat lower stationary blade is connected to the underside of the head unit via a pair of bolts, and an upper blade is connected to the oscillating drive arms, for moving back and forth in a wiping motion relative to the adjacent stationary blade, under control of the oscillating drive arms.

In operation, the unit is passed over the coat of hair on a cow, or other livestock, and while the hair is being combed by the stationary lower blade it is simultaneously sheared off by the wiping motion of the upper blade pressing against the lower blade.

The upper and lower blades gradually become dulled as a result of continuous use. Presently, cattle farmers are required to mail the blades back to the shearer/clipper manufacturer or take the blades by hand to an authorized distributor of the shearer/clipper who either sharpens them manually or utilizes a large industrial sharpening device for sharpening the blades. The inconvenience associated with mailing the blades or having to take the blades to an authorized distributor is significant, resulting in lost time and considerable expense.

Two examples of well known prior art blade sharpening devices are disclosed in U.S. Pat. Nos. 3,900,970 (Sollami) and 3,677,316 (Markham). Each of the prior art patents disclose complex and cumbersome apparatus for grinding blades or cutter bits. Because of their size and complexity, such prior art sharpeners are typically located in the premises of the manufacturer or the manufacturer's authorized distributors, and as a result are unavailable to the average farmer. Hence, as discussed, the cattle farmer is required to either mail his blades to the manufacturer or take the blades by hand to the distributor where they are sharpened using the complex machinery.

According to the present invention, a kit is provided for attachment directly to well known electric shearers/clippers for automatically sharpening the blades at their point of use, i.e. on the farm. In general, according to the present invention there is provided a sharpening kit comprised of a flat block having an abrasive surface, for connection to a shearer/clipper in place of the stationary blade, and apparatus for connecting a selected one of either the moving or stationary blades to the oscillating drive arms whereby the oscillating drive arms move the selected blade in a wiping motion relative to and bearing down on the abrasive surface, thereby sharpening the selected blade.

Thus, in contrast to prior art complex and large blade sharpeners, the sharpener of the present invention is portable, inexpensive, and easy to use. Blades may be sharpened at their point of use without requiring that they be mailed or taken by hand to the manufacturer's distributor. Thus, considerable expense and time is saved, resulting in increased efficiency of cattle farming operations.

Figure 2:
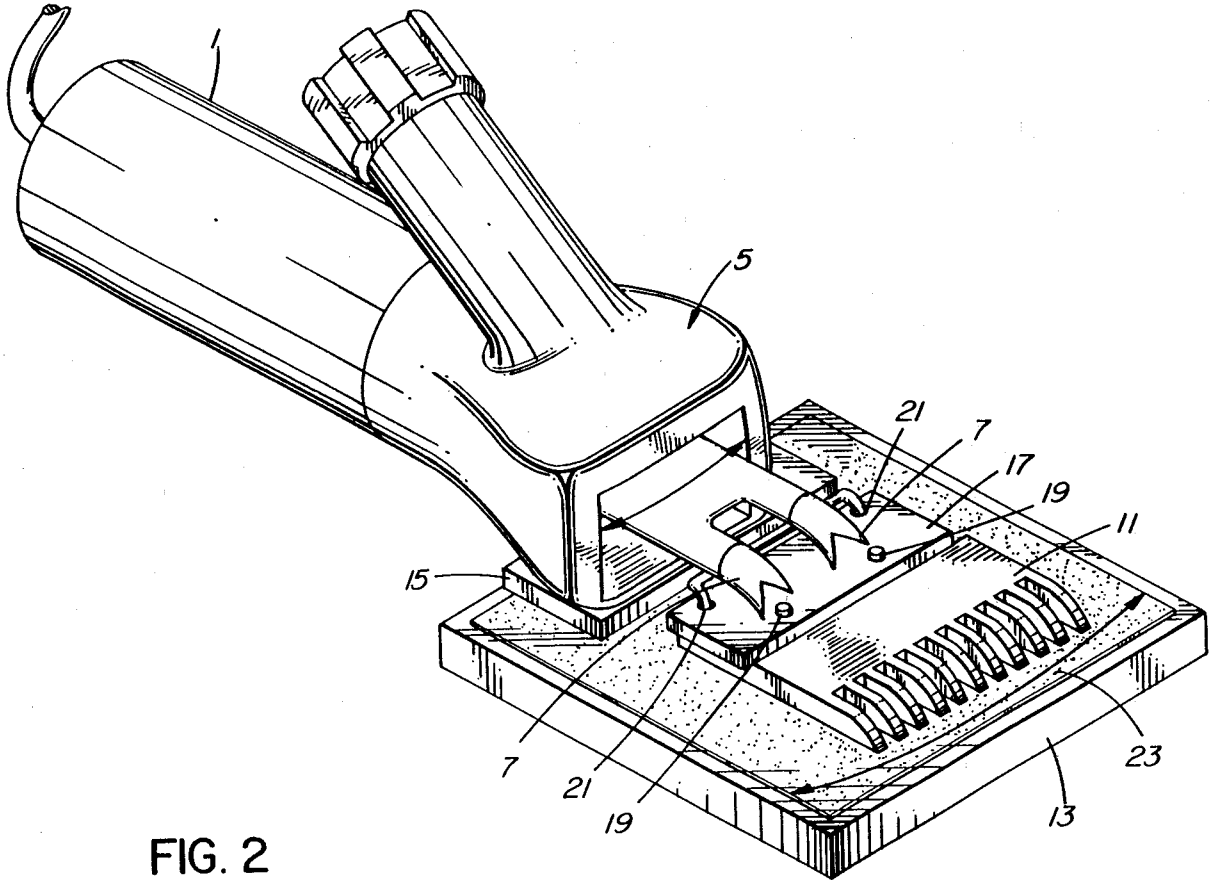
Figure 3:
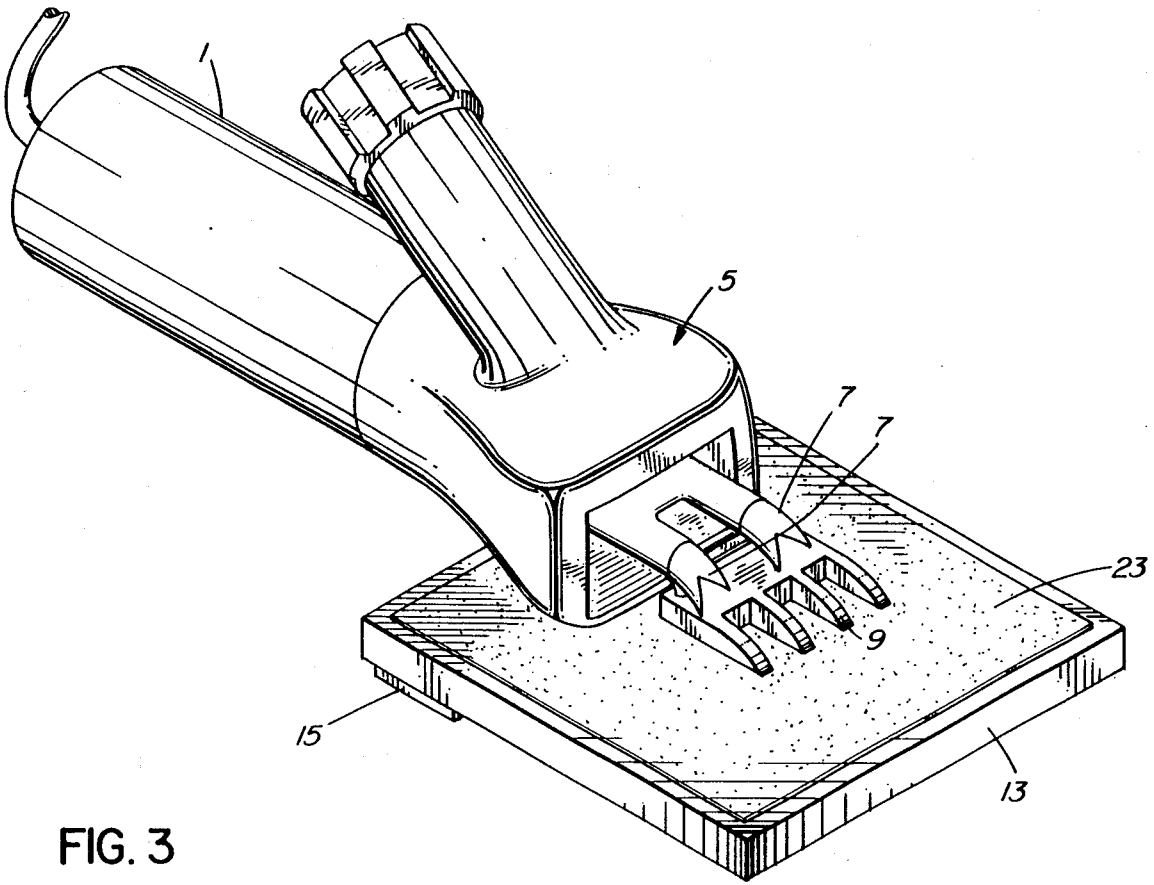
Figure 4A:
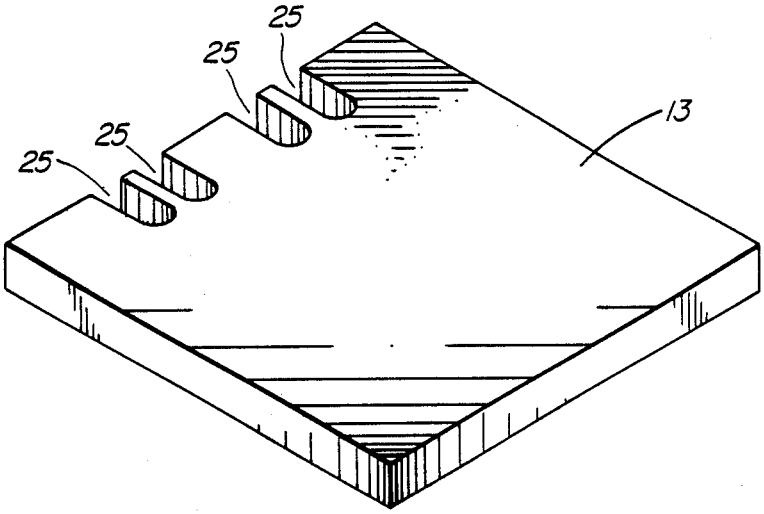
Figure 4B:
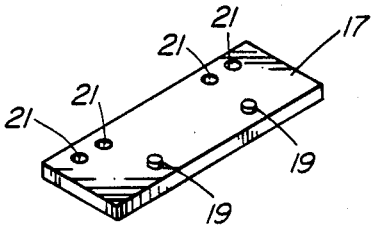
Figure 4C:
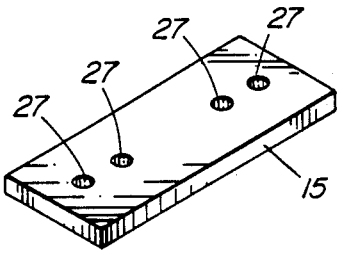

A better understanding of the present invention will be obtained with reference to the detailed description below in conjunction with the following drawings, in which:

FIG. 1 illustrates a well known electric cattle shearer/clipper according to the prior art, FIG. 2 illustrates a sharpening kit according to a preferred embodiment of the present invention, shown connected to a prior art electric shearer/clipper for sharpening the stationary blade thereof, FIG. 3 illustrates the sharpening kit of FIG. 2 shown connected to an electric shearer/clipper for sharpening the moving blade thereof, and FIGS. 4A, 4B and 4C illustrate various components of the sharpening kit according to the preferred embodiment.

With reference to FIG. 1, an electric cattle shearer/-clipper is shown comprised of a handle 1 having an electric cord 3 extending from the rear thereof, and a head portion shown generally as 5, having a pair of oscillating drive arms 7 extending therefrom. An upper blade 9 is connected to the oscillating drive arms 7, and a lower stationary blade 11 is connected to the bottom of the head unit 5 by means of a pair of threaded bolts (not shown).

As discussed above, in operation, the unit is passed over the coat of hair of a cow (or other livestock), and as the hair is combed by the stationary lower blade 11, the hair is sheared off by the wiping motion of the upper blade 9 pressing against the lower blade. The arrow in FIG. 1 illustrates the direction of motion of the oscillating drive arms 7 and upper blade 9.

With reference to FIG. 2, an arrangement is illustrated for sharpening the normally stationary lower blade 11 utilizing the sharpening kit according to the preferred embodiment of the present invention. The blade 11 is disconnected from the hand held head unit 5, and an ultra flat block 13 and spacer bar 15 are connected to the bottom of the head unit 5 via a further pair of threaded bolts (not shown). The further pair of bolts are similar to the first mentioned pair except slightly longer to accommodate the height of the block 13 and spacer bar 15.

The spacer bar 15 is sandwiched between the ultra flat block 13 and the bottom of the head unit 5, and secured through tightening of the aforementioned further bolts extending through the block 13 and spacer bar 15.

The lower blade 11 is turned upside down and connected to the oscillating drive arms 7 via a connector bar 17. Protrusions 19 on the top and bottom (not shown) of the connector bar 17 are inserted within corresponding holes (also not shown) typically disposed in the lower blade, and the oscillating drive arms 7 are inserted within holes 21 disposed in the connector bar 17.

As shown, a sheet of sandpaper 23 is placed on top of the ultra flat block 13 sandwiched between the block and the spacer bar 15. The sandpaper is preferably comprised of either aluminum or carborundum, in a well known manner.

Accordingly, in response to turning on the hand held unit, the lower blade 11 is wiped across the sandpaper 23 in an oscillating fashion, bearing down on the sandpaper and thereby sharpening the teeth of the blade.

With reference to FIG. 3, an arrangement is illustrated for sharpening the upper blade 9 according to the preferred embodiment. The ultra flat block 13 and spacer bar 15 are reversed from the configuration shown in FIG. 2, and the aforementioned further threaded bolts are inserted therethrough as discussed above. The upper blade 9 is connected in the usual fashion to the oscillating drive arms 7. In response to turning on the unit, the upper blade 9 is moved across the abrasive surface of the sandpaper 23 in a wiping motion, thereby sharpening the teeth of the blade.

With reference to FIG. 4, the component parts of the kit according to the present invention are illustrated.

In particular, FIG. 4A shows the ultraflat block 13, which is preferably made of stainless steel. Slots 25 are disposed in the rear portion of the block 13 for accommodating the aforementioned further threaded bolts, and allowing for adjustment or positioning of the block 13 when attached to the head unit 5 of the electric shearer/clipper.

As discussed above, a sheet of aluminum or carborundum sandpaper 23 is typically cut to size and rests on top of the stainless steel flat block 13, sandwiched between the block and head unit 5 according to the embodiment of FIG. 3, or between the block 13 and spacer bar 15, according to the embodiment of FIG. 2.

With reference to FIG. 4B the connector bar 17 is shown having protrusions 19 and holes 21 in the upper surface thereof. As discussed above, similar protrusions and holes are provided in the lower surface (not shown) for connection to the lower surface of the stationary blade 11.

With reference to FIG. 4C, the spacer bar 15 is shown having holes 27 disposed therein, aligned with the slots 25 in the ultra flat stainless steel block 13 (FIG. 4A), through which the aforementioned further threaded bolts pass.

As can be seen from the drawings, the sharpening kit according to the present invention is simple to use, and relieves the cattle farmer from having to either do without his shearer/clipper for a period of time while the blades have been sent to the distributor, or having to travel to the closest distributor and pay the cost of having the blades manually sharpened.

A person understanding the present invention may conceive of other embodiments thereof.

For example, block 13 may be manufactured with an integral abrasive surface, instead of requiring use of separate sandpaper sheets 23. Also, block 13 may be manufactured with spacer bar 15 integrally connected thereto, for easy attachment to the head unit 5.

Furthermore, the connector 17 may be adapted to connect practically any manner of blade, knife, cutter bit, etc., instead of merely cattle shearer/clipper blades.

Thus, numerous alternative embodiments of the present invention would have applications in fields other than livestock grooming.

All such alternative embodiments and modifications are believed to be within the sphere and scope of the present invention as defined by the claims appended hereto.

The embodiments of the invention in which an exclusive property or privilege is claimed are defined as follows:

1. For use in a shearer/clipper comprised of oscillating means for moving a first removable blade in a wiping motion relative to an adjacent removable stationary blade for effecting a shearing action therebetween; a sharpening kit comprised of a flat block for connection to said shearer/clipper in place of said removable stationary blade, an abrasive surface being provided on said block, and means for connecting a selected one of either said first or stationary blades to said oscillating means whereby said oscillating means moves said selected blade in a wiping motion relative to and bearing down on said abrasive surface thereby sharpening said selected blade.

2. A sharpening kit as defined in claim 1, wherein said flat block is comprised of an ultraflat steel block

3. A sharpening kit as defined in claim 2, wherein said abrasive surface is comprised of a sheet of sandpaper fixed to said block and sandwiched between said block and said selected blade.

4. A sharpening kit as defined in claim 3, wherein said sheet of sandpaper is comprised of one of either aluminum or carborundum.

5. A sharpening kit as defined in claim 1 for sharpening said stationary blade, wherein said means for connecting is comprised of a connector bar for connection to said oscillating means and an outside surface of said stationary blade, and further comprising a spacer bar sandwiched between said shearer and said block for providing clearance between said shearer and block signal to the depth of said connector bar, said block and spacer bar being connected to said shearer/clipper by means of a pair of threaded bolts passing therethrough and into said shearer/clipper.

6. A sharpening kit as defined in claim 1, for sharpening first blade, wherein said first blade is connected directly to said oscillating means and said block is connected to said shearer/clipper by means of a pair of threaded bolts passing therethrough and into said shearer/clipper.

* * * * *